US007648301B2

(12) United States Patent
Kim

(10) Patent No.: US 7,648,301 B2
(45) Date of Patent: Jan. 19, 2010

(54) COSMETIC CONTAINER

(75) Inventor: Yoon-Hoi Kim, Seoul (KR)

(73) Assignee: RND Group LLC, Englewood Cliffs, NJ (US)

( * ) Notice: Subject to any disclaimer, the term of this patent is extended or adjusted under 35 U.S.C. 154(b) by 0 days.

(21) Appl. No.: 11/629,623

(22) PCT Filed: Mar. 16, 2006

(86) PCT No.: PCT/KR2006/000954

§ 371 (c)(1),
(2), (4) Date: Dec. 15, 2006

(87) PCT Pub. No.: WO2006/098595

PCT Pub. Date: Sep. 21, 2006

(65) Prior Publication Data

US 2008/0019763 A1 Jan. 24, 2008

(30) Foreign Application Priority Data

Mar. 17, 2005 (KR) ..... 20-2005-0007267 U

(51) Int. Cl.
*A47L 13/22* (2006.01)

(52) U.S. Cl. ..... 401/281; 401/280

(58) Field of Classification Search ..... 401/269, 401/280, 281, 202, 205, 270, 282, 286
See application file for complete search history.

(56) References Cited

U.S. PATENT DOCUMENTS 4,121,106 A 10/1978 Terhune et al.
4,248,543 A * 2/1981 Carrington et al. ..... 401/183
4,748,990 A 6/1988 Brown et al. ..... 132/79
5,397,195 A 3/1995 Goncalves
6,547,471 B1 * 4/2003 Tucker et al. ..... 401/206
6,568,405 B2 * 5/2003 Masuyama ..... 132/218
6,905,277 B2 * 6/2005 Saito et al. ..... 401/281
2003/0000544 A1 * 1/2003 Byun ..... 132/320
2004/0047674 A1 * 3/2004 Geardino et al. ..... 401/205

(Continued)

FOREIGN PATENT DOCUMENTS

JP 54-108196 U 7/1979

(Continued)

*Primary Examiner*—David J Walczak
(74) *Attorney, Agent, or Firm*—Morgan Lewis & Bockius LLP

(57) ABSTRACT

A cosmetic container in which a cap having a brush formed therein is rotated to open a discharge port of cosmetic liquid. The cosmetic liquid is discharged into the brush so that a proper amount is uniformly coated. The cap is rotated in the reverse direction so as to close the discharge port to block the discharge of cosmetic liquid. The cosmetic container includes a container, a lower cap that is screw-coupled to the opening section of the container, a packing body being inserted and fixed to a hole formed in the center of the lower cap, a middle cap that is rotatably coupled to the upper portion of the lower cap and has a shaft tube formed in the center thereof, the shaft tube having a cutaway portion formed by cutting in the position corresponding to an open hole of the packing body, a brush that is formed in the upper portion of the shaft tube, and an external cap that is coupled to the upper portion of the middle cap.

7 Claims, 5 Drawing Sheets

U.S. PATENT DOCUMENTS

2004/0213628 A1* 10/2004 Thiebaut ..... 401/205

FOREIGN PATENT DOCUMENTS

| | | | |
|---|---|---|---|
| JP | 61-284494 A | 12/1986 | |
| JP | 62-298308 | 12/1987 | |
| JP | 5-18889 | 3/1993 | |
| JP | 7-330000 | 12/1995 | |
| JP | 2004-009400 | 1/2004 | |
| KR | 20-0367744 Y1 | 11/2004 | |

* cited by examiner

[Fig. 1]
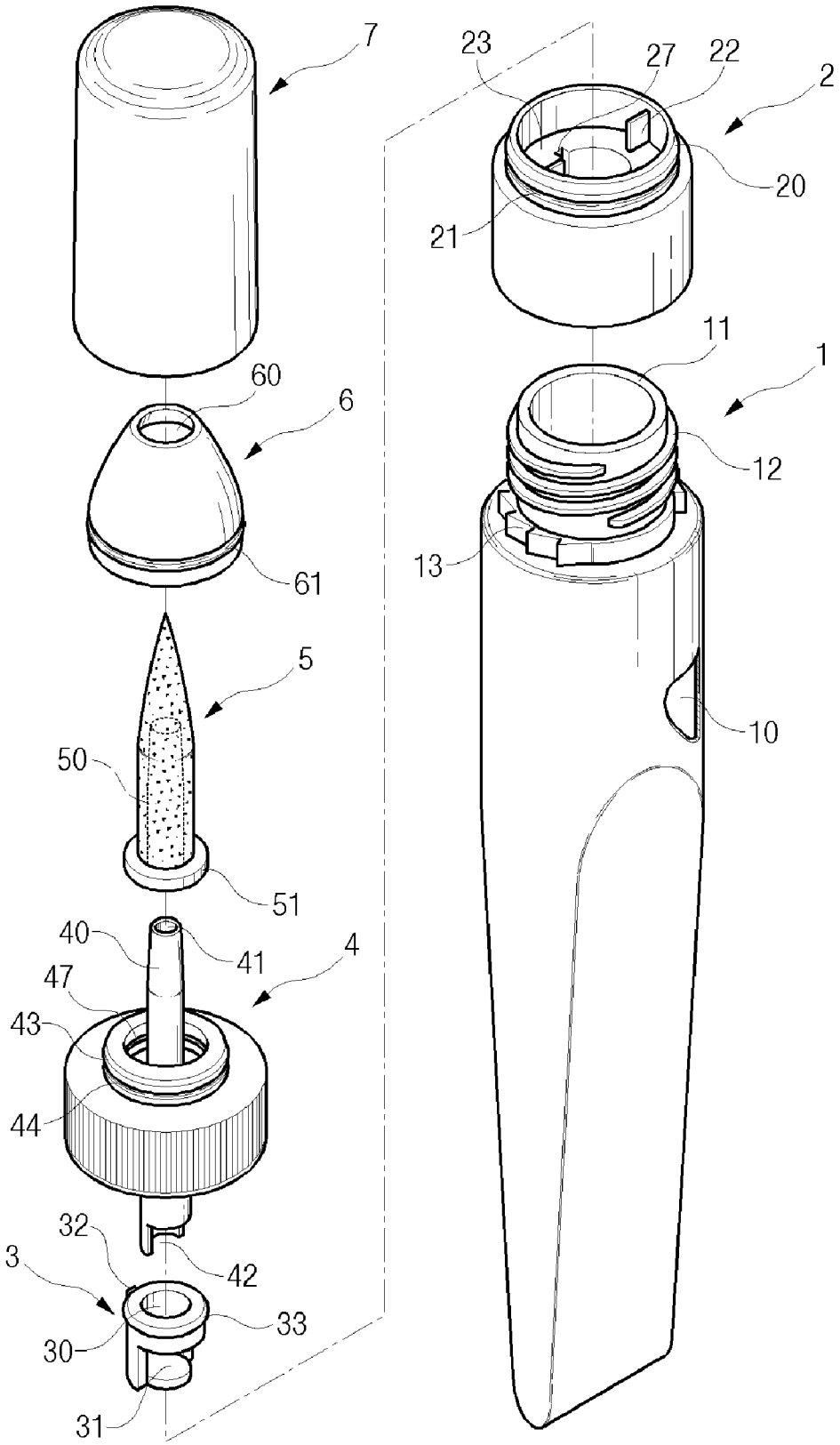

[Fig. 2]
(a)
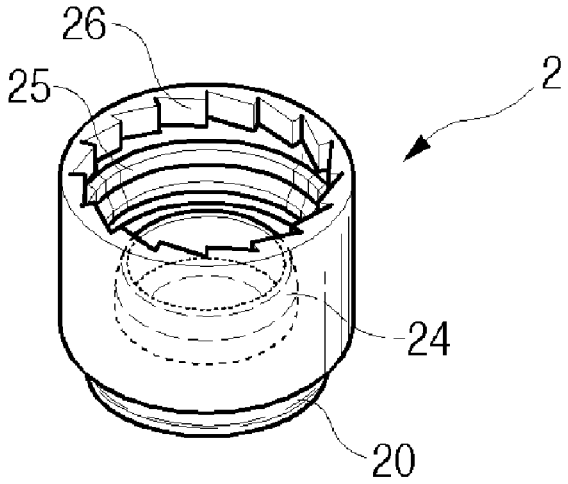
(b)
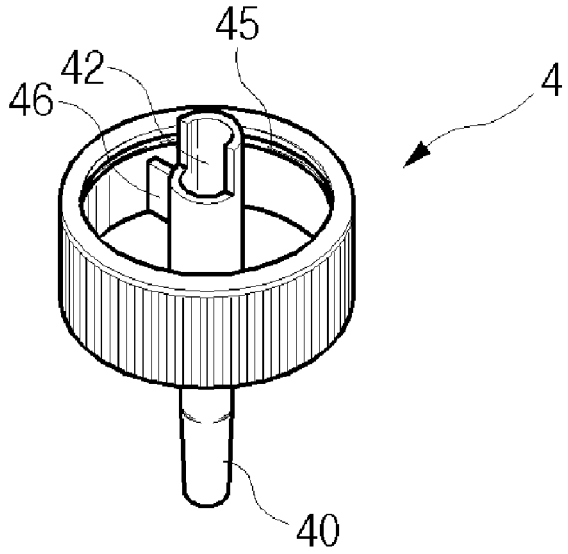

[Fig. 3]
(a)
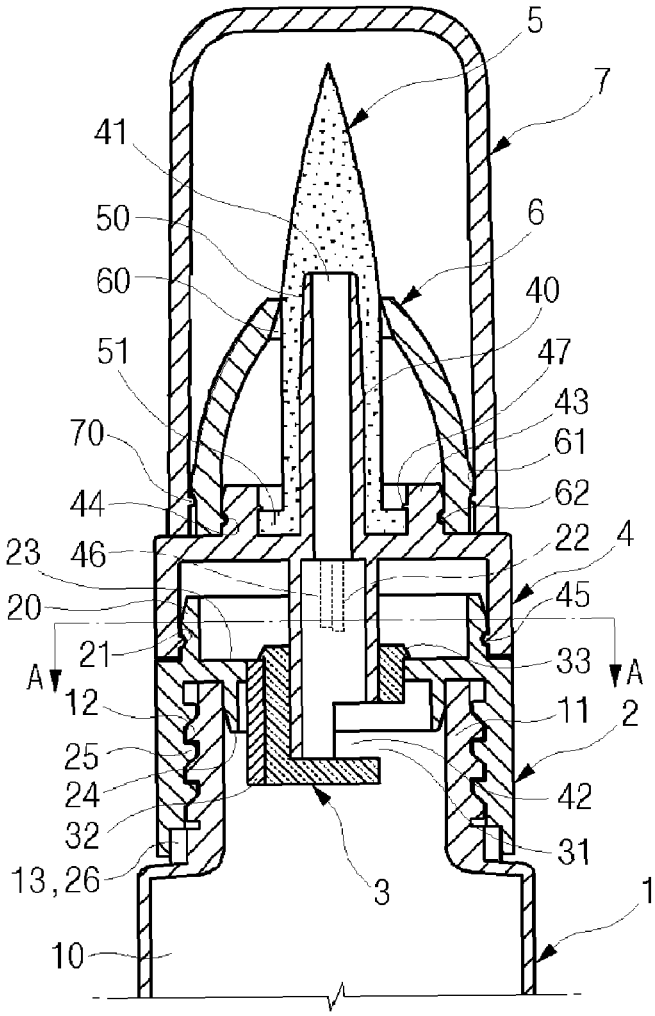
(b)
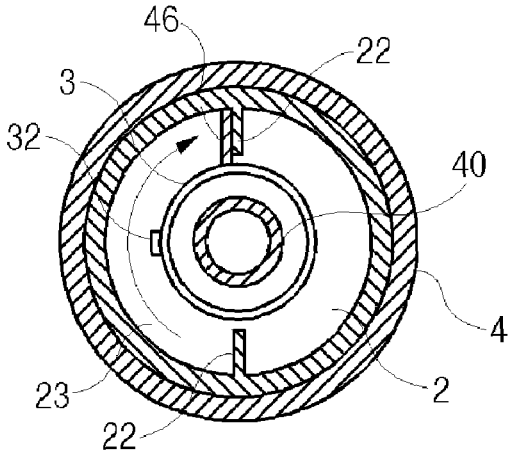

[Fig. 4]
(a)
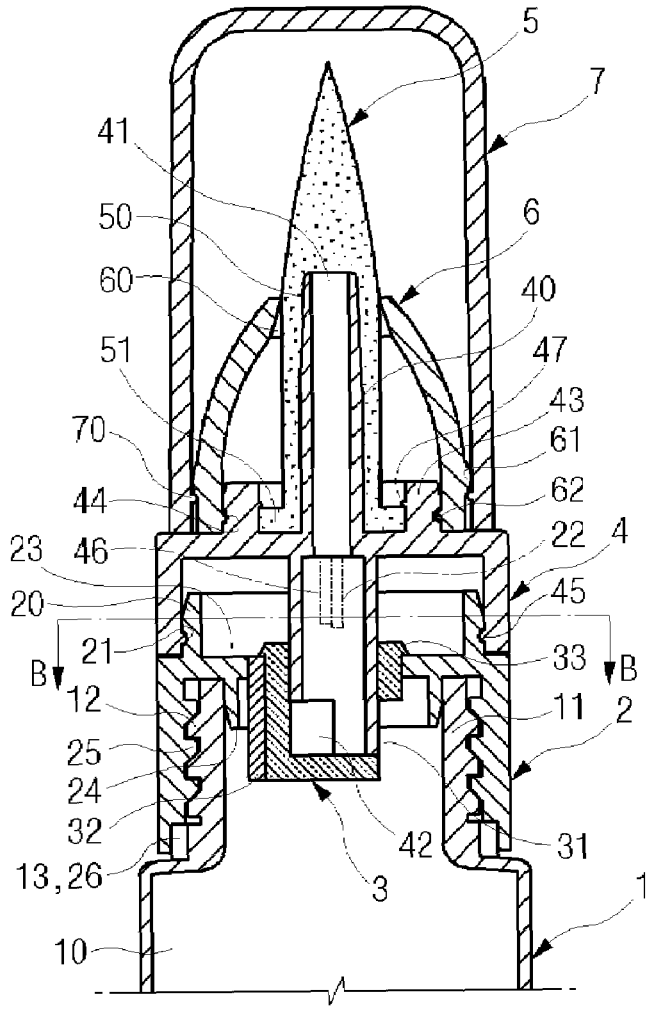
(b)
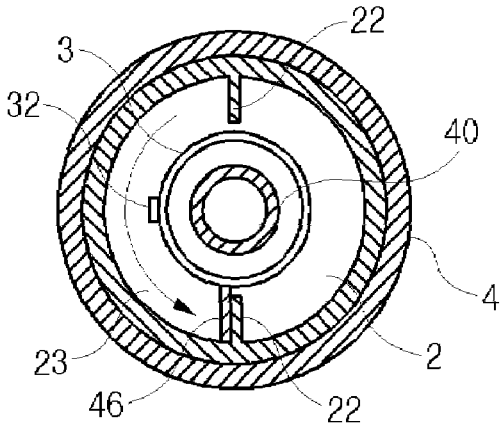

[Fig. 5]
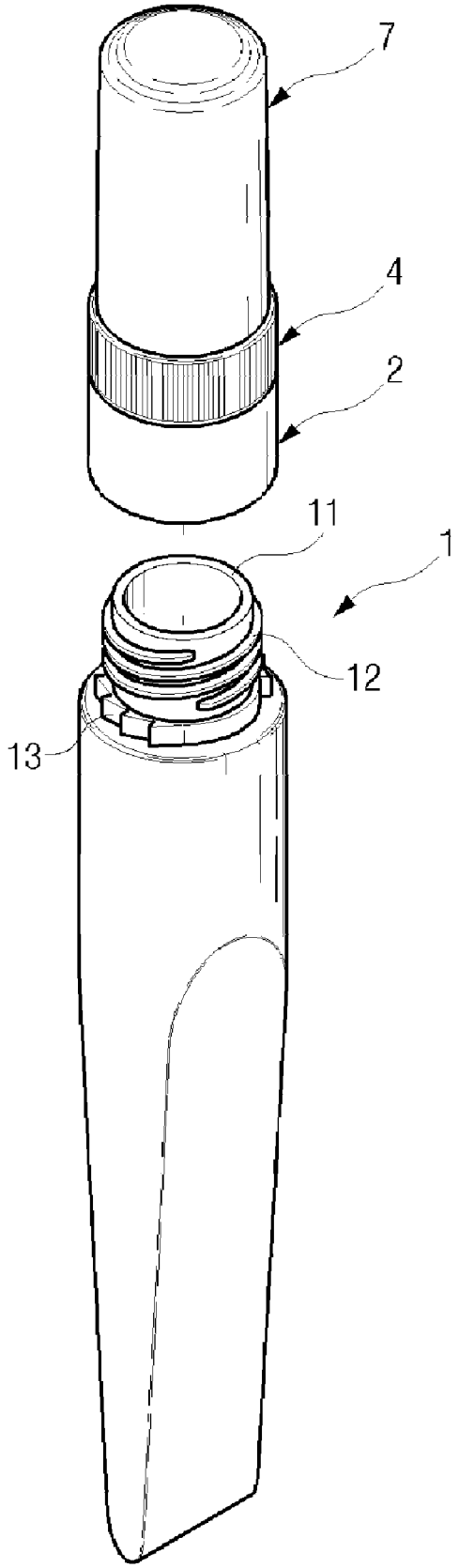

COSMETIC CONTAINER

TECHNICAL FIELD

The present invention relates to a cosmetic container which discharges liquid cosmetic contained in a container for use, and more specifically, to a cosmetic container in which a cap having a brush formed therein is rotated to open a discharge port of cosmetic liquid when a user wants to apply the cosmetic liquid, the cosmetic liquid is discharged into the brush so that a proper amount of cosmetic liquid is uniformly coated, and the cap is rotated in the reverse direction after the application so as to close the discharge port to block the discharge of cosmetic liquid.

BACKGROUND ART

In general, in a cosmetic container in which liquid cosmetic having fluidity such as liquid foundation or lip gloss is contained, a brush section is integrally formed in an opening section of the cosmetic container. In order to apply the liquid cosmetic, the container is set up upside down so that the brush section faces downward, or the container is constricted. Then, cosmetic liquid is supplied to the brush section so as to be applied on the skin.

The above-described general cosmetic container is not provided with an opening and closing unit which properly controls cosmetic liquid discharged into the brush section or blocks the supply thereof when the cosmetic container is not used. Accordingly, the cosmetic container must be kept carefully so that the cosmetic liquid is not discharged through the brush.

In addition, with the general cosmetic container, a user cannot adjust a discharge amount of cosmetic liquid because the discharge amount of cosmetic liquid is determined according to the inner diameter of a discharge tube formed in the center of the brush section.

In order to solve the above-described problems, the cosmetic container which has been already applied by the present applicant is disclosed in Korea Utility Model Registration Gazette No. 2004-0024892 (hereinafter, referred to as 'the related art').

The cosmetic container is basically composed of a coating member and a container section. The cosmetic container is provided with a packing body that is coupled and fixed to the inside of an entrance section formed in the container section so as to provide a discharge path of cosmetic liquid; a rotating body that opens and closes the discharge path of cosmetic liquid of the packing body; a position control member that covers the upper portion of the packing body and that is coupled and fixed to the outside of the entrance section and is coupled to the rotating body so as to control the rotation of the rotating body; a fixing member that is coupled and fixed to the upper portion of the rotating body and that has a storage groove in which the coating member is laid. The packing body is provided with an insertion groove. On the side of the insertion groove, an opening section is bored. The rotating body has a shaft pole formed therein, which is inserted into the insertion groove. The shaft pole has a discharge port formed thereon, which is smaller than the opening section of the insertion groove.

The components of the cosmetic container are assembled in the following method. The packing body is coupled to the inside of the entrance section of the container section in which cosmetic liquid is contained, and the position control member is coupled and fixed to the outside thereof. Then, the rotating body integrated with the fixing member is rotatably coupled to the upper portion of the position control member.

Here, the portion of the shaft pole projecting below a rotating plate of the rotating body is inserted into the insertion groove of the packing body through the center hole of the position control member. The portion of the shaft pole projecting above the rotating plate is positioned in the lower portion of the coating member through a supporting rod of the fixing member. A stopper formed on the bottom surface of the rotating plate is inserted into a guide groove of the position control member. When the rotating body is rotated, the shaft pole inserted into the insertion groove is rotated together so as to open and close the opening section of the insertion groove. Therefore, only when a user applies the cosmetic liquid, the cosmetic liquid can be drawn out.

Accordingly, in the related art as described above, the opening and closing unit is provided to properly control cosmetic liquid discharged into the brush section and to block the supply of cosmetic liquid when the cosmetic container is not used, which makes it possible to solve the problems of the general cosmetic container.

DISCLOSURE OF INVENTION

Technical Problem

However, in the cosmetic container having such a construction according to the related art, the structure thereof is complicated because a number of parts are used.

Further, the cosmetic container is manufactured through a process where the packing body is inserted into the container section after the cosmetic liquid is filled in the container section and the upper portion of the container section is coupled to the cap section in which the rotating body, the position control member, and the fixing member are integrally joined. Therefore, the manufacturing process is also complicated.

Technical Solution

The present invention has been finalized in view of the drawbacks inherent in the conventional cosmetic container, and an object of the invention is that it provides a cosmetic container including an opening and closing unit in which a middle cap of a cap section coupled to a container is rotated to open and close an open hole so that a discharge amount of cosmetic liquid discharged into the brush can be adjusted, when a user uses the cosmetic container provided with the brush.

Another object of the invention is that it provides a cosmetic container which can be conveniently and quickly manufactured only by a process where a container and a cap section in which a brush and an opening and closing unit are integrally formed are separated so that cosmetic liquid is filled in the container when the cosmetic container is manufactured and are then coupled to each other.

According to an aspect of the invention, a cosmetic container includes a container having an opening section formed in one side thereof, through which cosmetic liquid is filled in a containing section; a lower cap that is screw-coupled to the opening section of the container; a packing body having an open hole formed in the end portion thereof, the packing body being inserted and fixed to a hole formed in the center of the lower cap so as to provide a discharge path of cosmetic liquid; a middle cap that is rotatably coupled to the upper portion of the lower cap and has a shaft tube formed in the center thereof, the shaft tube having an open section formed by cutting in the position corresponding to the open hole of the packing body and being inserted into a spatial section of the packing body so as to provide the discharge path of cosmetic liquid; a brush that is formed in the upper portion of the shaft tube; and an external cap that is coupled to the upper portion of the middle cap so as to protect the brush.

According to another aspect of the invention, the cosmetic container further includes a brush cover that is put on the upper side of the brush and is coupled to the upper portion of the middle cap so as to put together the brush formed in the shaft tube of the middle cap.

On the lower surface of the middle cap, a stopper is formed, of which a portion is inserted into a concave section of the lower cap and is rotated so that the middle cap is rotated in the range of a predetermined angle with respect to the lower cap, and in the upper portion of the lower cap, two rotating limiting walls are formed to limit the rotation range of the stopper.

The angle range defined by the rotation limiting walls formed in the upper portion of the middle cap is less than 180°.

In the hole formed in the center of the lower cap, a key groove is formed so that the packing body coupled to the lower cap is prevented from being rotated when the middle cap is rotated, and on the outer circumference of the packing body, a key is formed in the vertical direction.

On the lower portion of the outer circumference of the opening section of the container and the lower portion of the inner circumference of the lower cap, latch gears are respectively formed so that the fixing of the lower cap screw-coupled to the opening section of the container is not released.

Advantageous Effects

The cosmetic container according to the present invention is provided with the opening and closing unit in which the middle cap of the cap section coupled to the container is rotated to open and close the open hole, in order to adjust a discharge amount of cosmetic liquid discharged into the brush when a user uses the cosmetic container provided with the brush. Further, the cosmetic container is divided into the container and the cap section in which the brush and the opening and closing unit are integrally formed. Therefore, the cosmetic container can be conveniently and quickly manufactured only by the process in which the container and the cap section are coupled to each other after the cosmetic liquid is filled in the container.

The closing and opening means is composed of the lower cap that is coupled to the opening section of the container; the packing body that is inserted into the hole formed in the center of the lower cap so as to provide the discharge path through the open hole; the middle cap that is rotatably coupled to the upper portion of the lower cap so as to provide the discharge path through the open section formed in the lower end of the shaft tube which is inserted into the packing body.

Accordingly, when the middle cap of the opening and closing unit is rotated in the range of 180°, the open hole of the packing body and the open section of the middle cap coincide with each other to thereby open the discharge port of cosmetic liquid. Alternately, the open hole of the packing body and the open section of the middle cap face in the opposite direction to each other to thereby close the discharge port of cosmetic liquid. This means that the opening and closing operation can be performed simply and conveniently. If the middle cap is rotated within the range of 180°, the cross-sectional area of the discharge path is adjusted so that the discharge amount of cosmetic liquid can be adjusted.

In addition, since the packing body is coupled to the lower cap by the key, the packing body is not rotated but fixed when the middle cap is rotated. Therefore, the opening and closing operation can be performed reliably by rotating the middle cap.

BRIEF DESCRIPTION OF THE DRAWINGS

FIG. 1 is an exploded perspective view illustrating a cosmetic container according to the present invention.

FIG. 2(*a*) is a perspective bottom view illustrating a lower cap of FIG. 1.

FIG. 2(*b*) is a perspective bottom view illustrating a middle cap of FIG. 1.

FIG. 3(*a*) is an assembled cross-sectional view illustrating the cosmetic container according to the invention, showing a state where the middle cap thereof is rotated so that a discharge port is opened.

FIG. 3(*b*) is a cross-sectional view taken along A-A' line of FIG. 3(*a*).

FIG. 4(*a*) is an assembled cross-sectional view illustrating the cosmetic container according to the invention, showing a state where the middle cap thereof is rotated so that the discharge port is closed.

FIG. 4(*b*) is a cross-sectional view taken along B-B' line of FIG. 4(*a*).

FIG. 5 is a perspective view showing a state where a container and cap section of the cosmetic container according to the invention are separated from each other.

BEST MODE FOR CARRYING OUT THE INVENTION

Hereinafter, a preferred embodiment according to the present invention will be described in detail with reference to the accompanying drawings.

FIG. 1 is an exploded perspective view illustrating a cosmetic container according to the invention, FIG. 2(*a*) is a perspective bottom view illustrating a lower cap of FIG. 1, and FIG. 2(*b*) is a perspective bottom view illustrating a middle cap of FIG. 1.

As shown in FIGS. 1 to 2*b*, the cosmetic container is composed of a container 1, a lower cap 2, a packing body 3, a middle cap 4, a brush 5, a brush cover 6, and an external cap 7.

The packing body 3 is inserted into a hole formed in the center of the lower cap 2 so that the packing body 3 and the lower cap 2 are integrated with each other. The brush 5 is inserted into a shaft tube 40 projecting upward in the center of the middle cap 4 so that the brush 5 and the middle cap 4 are integrated with each other. After the brush 5 is coupled, the brush cover 6 is coupled to the upper side of the middle cap 4.

The middle cap 4 to which the brush cover 6 and the brush 5 are joined is rotatably coupled to the upper portion of the lower cap 2 to which the packing body 3 is coupled, thereby composing an opening and closing unit for adjusting a discharge amount of cosmetic liquid.

Accordingly, the construction shown in FIG. 1 is simply divided into the container 1 and the opening and closing unit in which the plurality of components such as the external cap 7 and the like are joined in each other.

The respective components of the cosmetic container according to the invention will be described in detail as follows.

The container 1 contains a liquid cosmetic. Inside the container 1, a containing section 10 is formed, in which cosmetic liquid is filled or contained. In the upper section of the container 1, an opening section 11 is formed.

On the outer circumference of the opening section 11, a male screw section 12 is formed so as to be screw-coupled to the lower cap 2. On the lower portion of the outer circumference thereof, a latch gear 13 is formed to project in the circumferential direction.

The latch gear 13 is such a unit that, when the lower cap 2 is screw-coupled, prevents the lower cap 2 from rotating in the opposite direction so that the coupling therebetween is not released. On the lower portion of the inner circumference of the lower cap 2, a latch gear 26 is also formed to correspond to the latch gear 13 of the opening section 11.

The container 1 is formed of synthetic resin. Preferably, in order to constrict the container 1 so that cosmetic liquid is easily discharged, the container 1 may formed of soft synthetic resin. In addition, the container 1 may formed to be transparent so that the state of cosmetic liquid, which is filled or contained in the containing section 10, can be checked from outside.

The lower cap 2, which is screw-coupled to the opening 11 of the container 1 so as to close the container 1, serves as a base in which the packing body 3 and the middle cap 4, which are main components of the opening and closing unit, are installed and fixed. In the center of the lower cap 2, a hole is formed, into which the packing body 3 is inserted. In the hole, a key groove 27 is formed, into which a key 32 vertically formed in the outer circumference of the packing body 3 is inserted.

In the upper portion of the lower cap 2, a rim section 20 is formed to be coupled to the lower portion of the middle cap 4. On the outer circumference of the rim section 20, a coupling groove 21 is formed, into which a coupling projection 45 (refer to FIG. 2(*b*)) of the middle cap 4 is inserted.

In the upper portion of the lower cap 2, a concave section 23 is formed inside the rim section 20 so that a portion of a stopper 46 (refer to FIG. 2(*b*)) formed on the lower surface of the middle cap 4 is inserted to rotate when the middle cap 4 is rotatably coupled. In order to limit the rotation range of the middle cap 4, a pair of rotation limiting walls 22 are formed on the inner circumference of the rim section 20 so that the stopper 46 rotating at a predetermined angle is stopped. The rotation limiting walls 22 correspond to each other in the diameter direction of rim section 20.

Preferably, the concave section 23 may have such a depth that the lower end of the stopper 46 does not come in contact with the bottom surface of the concave section 23 when the middle cap 4 is coupled to the upper portion of the lower cap 2. In addition, the range of rotation angle, which is defined by two of the rotation limiting walls 22 formed on the inner circumference of the rim section 20 of the lower cap 2, may be lower than 180°, and thus the middle cap 4 may be rotated in the range of 0 to 180° with respect to the lower cap 2 to thereby control the opening and closing unit.

On the lower portion of the inner circumference of the lower cap 2, a female screw section 25 is formed to be screw-coupled to the male screw section 12, as shown in FIG. 2(*a*). On the lower end of the inner circumference thereof, the latch gear 26 is formed to correspond to the latch gear 13 of the container 1. On the lower surface inside the lower cap 2, a guide rim section 24 is formed to project downward so as to be in close contact with the inner circumference of the opening section 11 of the container 1 when the lower cap 2 is screw-coupled to the container 1.

The packing body 3 is inserted and fixed to the hole formed in the center of the lower cap 2 so as to provide a discharge path of cosmetic liquid contained in the container 1. In the center of the packing body 3, a hole is formed, into which the shaft tube 40 of the middle cap 4 is inserted. On the outer circumference thereof, the key 32 is formed in the vertical direction. In a portion of the lower end thereof, an open hole 31 is formed. In addition, on the upper portion of the outer circumference of the packing body 3, a projection 33 is formed to be received on the concave section 23 when the packing body 3 is inserted into the hole formed in the center of the lower cap 2.

Preferably, the open hole 31 of the packing body 3 may be formed in the range of 180° so that the discharge path is secured at the maximum when the middle cap 4 is rotated at 180°.

The middle cap 4 is rotatably coupled to the upper portion of the lower cap 2, to which the packing body 3 is coupled. With the middle cap 4 being rotated, a cutaway portion 42 formed in the lower end of the shaft tube 40 of the middle cap 4 coincides with or deviates from the open hole 31 of the packing body 3. Then, the discharge path of cosmetic liquid is opened and closed, and the size of the discharge path is adjusted.

Accordingly, in the center of the middle cap 4, the shaft tube 40 is vertically formed, which passes through the upper and lower portions of the middle cap 4. In the center of the shaft tube 40, a discharge port 41 is formed, from which cosmetic liquid is discharged. The upper portion of the shaft tube 40 is formed in a tapered shape, where the outer diameter thereof gradually decreases toward the upper end, so that the brush 5 is easily inserted. The lower portion of the shaft tube 40 is formed to have the same outer diameter as the inner diameter of a spatial section 30 of the packing body 3 so as to be closely inserted into the spatial section 30. As shown in FIG. 2(*b*), in the lower portion of the outer circumference of the shaft tube 40, the cutaway portion 42 is formed by cutting in the position corresponding to the oven hole 31 so as to be inserted into the spatial section 30 of the packing body 3 to communicate with the open hole 31. Preferably, the cutaway portion 42 may be cut in the range of 180° the same as the open hole 31 of the packing body 3.

On the outer circumference of the middle cap 4, a friction surface is formed, which is held by hand so as to facilitate the rotation of the middle cap 4. On the upper surface of the middle cap 4 around the shaft tube 40, a ring-shaped rim section 43 is formed to project. On the outer circumference of the rim section 43, a coupling groove 44 is formed, to which a coupling projection 62(refer to FIG. 3(*a*)) formed on the inner surface of the brush cover 6 is coupled. Accordingly, the upper surface of the middle cap 4 is divided into an outside upper surface and inside upper surface, with the rim section 43 being the boundary therebetween. In the inside upper surface, a flange 51 of the brush 5 is received.

The brush 5 is inserted into the upper portion of the shaft tube 40 formed in the center of the middle cap 4 so that the brush 5 and the shaft tube 40 are integrally coupled or attached to each other.

Here, the brush 5 is attached to the shaft tube 40 in the following method. On the inner circumference of the rim section 43 of the middle cap 4, a fixing projection 47 is formed. When the brush 5 is put on the shaft tube 40, the upper end of the flange 51 of the brush 5 is locked to the fixing projection 47 so that the brush 5 is fixed. In order to improve the fixing of brush 5 fixed by the fixing projection 47, the lower end of the brush 5 or the inner surface of a spatial section 50 can be coated with an adhesive so as to be attached to the inside upper surface of the middle cap 4.

In addition, the brush 5 can be coupled to the shaft tube 40 in another method. The lower end of the brush 5 or the inner surface of the spatial section 50 is coated with an adhesive so as to be attached to the shaft tube 40 and the inside upper surface of the middle cap 4. Alternately, the lower end of the brush 5 and the inside upper surface of the middle cap 4 are attached to each other by thermal bonding.

As shown in FIG. 2(*b*), on the lower surface of the middle cap 4, the stopper 46 is formed to be rotatably inserted into the concave section 23 formed on the upper surface of the lower cap 2, so that the middle cap 4 is coupled to the lower cap 2 to be rotated in the range of a predetermined angle, that is, 180°. Further, the stopper 46 is formed to be orthogonal to the front side of the cutaway portion 42 of the middle cap 4. When the stopper 46 is rotated at 180°, the cutaway portion 42 of the middle cap 4 is caused to face the front or back side, and thus the discharge path, formed by the open hole 31 of the packing body 3 and the cutaway portion 42 of the middle cap 4, is opened or closed.

The brush 5, which absorbs cosmetic liquid discharged from the discharge port 41 of the shaft tube 40 formed in the middle cap 4 so as to apply the cosmetic liquid, is manufactured by forming a hairy brush or flock in a suitable shape. The upper end of the brush 5 is formed to be as sharp as that of a typical brush, and the lower end of the brush 5 is formed with the flange 51 so as to be received on the inside upper surface of the middle cap 4. Inside the brush 5, the spatial section 50 is formed, into which the shaft tube 40 is inserted through the bottom surface.

The brush cover 6 is inserted into the upper side of the brush 5 and is coupled to the upper portion of the middle cap 4 so as to put together the upper portion of the brush 5. The lower portion of the brush cover 6 is formed to have such an inner diameter that it can be coupled to the outside of the rim section 43 of the middle cap 4, and the upper portion thereof has a hole 60 formed to put together the upper portion of the brush 5. The brush cover 6 is formed in a conical shape where the caliber gradually decreases toward the upper portion thereof.

On the lower portion of the inner circumference of the brush cover 6, a coupling projection 62(refer to FIG. 3(*a*)) which is locked to the coupling groove 44 of the middle cap 4 is formed to project. On the lower portion of the outer circumference thereof, an outside projection 61, to which the external cap 7 is coupled and fixed, is formed to project in the circumferential direction.

The external cap 7 is a cap which is coupled to the brush cover 6 so as to protect the brush 5, when the cosmetic container is not used. The external cap 7 is formed in a cylindrical shape where the bottom portion thereof is opened.

On the lower portion of the inner circumference of the external cap 7, a lock projection 70 (refer to FIG. 3(*a*)) is formed to project in the circumferential direction so as to be locked to the outside projection 61 of the brush cover 6 when the external cap 7 is coupled to the brush cover 6.

FIG. 3(*a*) is an assembled cross-sectional view illustrating the cosmetic container according to the invention, showing a state where the middle cap thereof is rotated so that the discharge port is opened. FIG. 3(*b*) is a cross-sectional view taken along A-A' line of FIG. 3(*a*).

The cosmetic container shown in FIG. 3(*a*) is divided into the container 1 and the cap section in which the lower cap 2, the packing body 3, the middle cap 4, the brush 5, the brush cover 6, and the external cap 7 are joined to each other. After being filled with cosmetic liquid, the container 1 is finally coupled to the cap section to thereby complete the manufacturing process of the cosmetic container.

Hereinafter, a process where the cap section is assembled will be described with reference to FIG. 3(*a*). A method in which the middle cap 4 is controlled to open the discharge port 41 will be described with reference to FIG. 3(*a*) and (*b*).

First, the packing body 3 is inserted into the hole formed in the center of the lower cap 2. At this time, the key 32 of the packing body 3 is inserted into the key groove 27 formed on the hole of the lower cap 2 so that the packing body 3 is not rotated when the middle cap 4 rotates. After the packing body 3 is coupled to the lower cap 2, the middle cap 4 is coupled to the upper portion of the lower cap 2. At this time, a portion of the stopper 46 formed on the lower surface of the middle cap 4 is inserted into the concave section 23 formed on the upper surface of the lower cap 2, and the lower end portion of the shaft tube 40 of the middle cap 4 is closely inserted into the spatial section 30 of the packing body 3. After the lower cap 2 is coupled to the middle cap 4, the coupling projection 45 formed on the lower portion of the inner circumference of the middle cap 4 is engaged with the coupling groove 21 formed on the outer circumference of the rim section 20 of the lower cap 2 so that the coupling projection 45 and the coupling groove 21 are coupled to each other. If the middle cap 4 is rotated, it is rotated along the coupling groove 21 in a state where the coupling projection 45 is locked to the coupling groove 21, which means the coupling groove 21 serves as a guide groove for the rotation of the middle cap 4.

After the lower cap 2, the packing body 3, and the middle cap 4 are assembled, the brush 5 is inserted into the shaft tube 40 of the middle cap 4. Then, the lower end portion of the brush 5 is attached to the inside upper surface formed between the shaft tube 40 of the middle cap 4 and the rim section 43.

After that, the brush cover 6 is fitted into the upper side of the brush 5 to put together the upper portion of the brush 5. If the brush cover 6 and the middle cap 4 are coupled to each other, the coupling projection 62 formed on the lower portion of the inner circumference of the brush cover 6 is locked to the coupling groove 44 formed on the outer circumference of the rim section 43 of the middle cap 4.

After the brush cover 6 is coupled, the external cap 7 is coupled to the upper portion of the brush cover 6. At this time, a lock projection 70 formed on the lower portion of the inner circumference of the external cap 7 is locked to the outside projection 61 of the brush cover 6.

According to the above-described assembling procedure, the lower cap 2, to which the packing body 3 is coupled, is coupled to the middle cap 4, and the brush 5 is attached to the shaft tube 40 of the middle cap 4. However, the assembling procedure is not limited thereto, and it may be varied as follows. After the brush 5 is attached to the shaft tube 40 of the middle cap 4, the middle cap 4 is coupled to the lower cap 2 to which the packing body 3 is coupled.

After the cap section is completely assembled as described, cosmetic liquid is filled in the containing section 10 of the container 1, and the cap section is coupled to the container 1 to thereby complete the manufacturing of cosmetic container. At this time, when the cap section, that is, the lower cap 2 is completely screw-coupled to the opening section 11 of the container 1, the latch gear 26 formed on the lower portion of the inner circumference of the lower cap 2 is geared to the latch gear 13 formed on the lower portion of the opening section 11 of the container 1, so that the cap section does not rotate in the reverse direction.

If the cosmetic container according to the invention is completely assembled as shown in FIG. 3(*a*), a user holds the middle cap 4 after separating the external cap 7. Further, the user rotates the middle cap 4 as shown in FIG. 3(*b*) so that the cutaway potion 42 formed in the lower end of the shaft tube 40 of the middle cap 4 coincides with the open hole 31 of the packing body 3. Then, the discharge path is secured, and thus the discharge port 41 is opened. Accordingly, if the user constricts the container 1 or sets up the container 1 so that the container 1 faces upward, the cosmetic liquid is discharged through the discharge port 41 so as to be applied on the skin. Here, when the middle cap 4 is rotated, the stopper 46 of the middle cap 4 is rotated at 180° in the clockwise direction in a state where a portion thereof is inserted into the concave section 23 of the lower cap 2. When the stopper 46 reaches the rotation limiting wall 22 of the lower cap 2, the rotation thereof is stopped. At this time, the cutaway portion 42 of the middle cap 4 coincides with the open hole 31 of the packing body 3 to thereby secure the discharge path.

FIG. 4(*a*) is an assembled cross-sectional view illustrating the cosmetic container according to the invention, showing a state where the middle cap thereof is rotated so that the discharge path is closed. FIG. 4(*b*) is a cross-sectional view taken B-B' line of FIG. 4(*a*).

Referring to FIG. 4(*a*) and (*b*), a method will be described in which the middle cap 4 is controlled to close the discharge port 41.

After applying the liquid cosmetic by controlling the middle cap 4 as in FIG. 3(*a*), the user holds the middle cap 4 and rotates it as shown in FIG. 4(*b*). Then, if the cutaway portion 42 formed in the lower end of the shaft tube 40 of the middle cap 4 is controlled so as to face in the opposite direction to the open hole 31 of the packing body 3, the discharge port is blocked to close the discharge port 41. After that, if the external cap 7 is coupled, the cosmetic container becomes in a state of FIG. 4(*a*). Here, when the middle cap 4 is rotated, the stopper 46 of the middle cap 4 is rotated at 1800 in the counter clockwise direction in a state where a portion thereof is inserted into the concave section 23 of the lower cap 2. Then, if the stopper 46 reaches the rotation limiting wall 22 of the lower cap 2, the rotation thereof is stopped. At this time, the cutaway portion 42 of the middle cap 4 is caused to face in the opposite direction to the open hole 31 of the packing body 3 to thereby block the discharge path.

FIG. 5 is a perspective view illustrating the cosmetic container according to the invention, showing a state where the container and the cap section thereof are separated from each other in order to fill cosmetic liquid in the containing section 10 of the container 1.

The cosmetic container according to the invention can be conveniently and quickly manufactured as described above. That is, the cosmetic liquid is filled in the container 1, and the container 1 is coupled to the cap section to thereby complete the manufacturing of cosmetic container. In the method described in FIG. 3(*a*), the cap section is assembled, in which the lower cap 2, the packing body 3, the middle cap 4, the brush 5, the brush cover 6, and the external cap 7 are joined to each other. When the container 1 is provided, the cosmetic liquid is filled in the container 1. The cap section is screw-coupled to the opening section 11 of the container 1. At this time, if the cap section is completely rotated, the latch gears 13 and 26 are geared to each other, which are respectively formed on the lower portion of the inner circumference of the lower cap 2 and the lower portion of the outer circumference of the opening section 11 of the container 1. Therefore, the lower cap 2 is prevented from being rotated in the reverse direction, and thus the fixing between the cap section and the container 1 is securely maintained.

INDUSTRIAL APPLICABILITY

As described above, the cosmetic container according to the present invention is provided with the opening and closing unit in which the middle cap of the cap section coupled to the container is rotated to open and close the open hole, in order to adjust a discharge amount of cosmetic liquid discharged into the brush when a user uses the cosmetic container provided with the brush. Further, the cosmetic container is divided into the container and the cap section in which the brush and the opening and closing unit are integrally formed. Therefore, the cosmetic container can be conveniently and quickly manufactured only by the process in which the container and the cap section are coupled to each other after the cosmetic liquid is filled in the container.

The closing and opening means is composed of the lower cap that is coupled to the opening section of the container; the packing body that is inserted into the hole formed in the center of the lower cap so as to provide the discharge path through the open hole; the middle cap that is rotatably coupled to the upper portion of the lower cap so as to provide the discharge path through the cutaway portion formed in the lower end of the shaft tube which is inserted into the packing body.

Accordingly, when the middle cap of the opening and closing unit is rotated in the range of 180°, the open hole of the packing body and the open section of the middle cap coincide with each other to thereby open the discharge port of cosmetic liquid. Alternately, the open hole of the packing body and the open section of the middle cap face in the opposite direction to each other to thereby close the discharge port of cosmetic liquid. This means that the opening and closing operation can be performed simply and conveniently. If the middle cap is rotated within the range of 180°, the cross-sectional area of the discharge path is adjusted so that the discharge amount of cosmetic liquid can be adjusted.

In addition, since the packing body is coupled to the lower cap by the key, the packing body is not rotated but fixed when the middle cap is rotated. Therefore, the opening and closing operation can be performed reliably by rotating the middle cap.

The invention claimed is:

1. A cosmetic container comprising:

a container having an opening section formed in one side thereof, through which cosmetic liquid is filled in a containing section;

a lower cap that is screw-coupled to the opening section of the container;

a packing body having an open hole formed in an end portion thereof, the packing body being inserted and fixed to a hole formed in the center of the lower cap so as to provide a discharge path of cosmetic liquid;

a middle cap that is rotatably coupled to an upper portion of the lower cap and has a shaft tube formed in the center thereof, the shaft tube having a cutaway portion formed by cutting a portion of a lower end of the shaft tube along the circumference of the shaft tube in the position in order to be aligned to the open hole of the packing body or be closed with respect to the open hole of the packing body selectively by rotation of the middle cap and being inserted into a spatial section of the packing body so as to provide the discharge path of cosmetic liquid;

a brush that is formed on the upper portion of the shaft tube; and an external cap that is coupled to the upper portion of the middle cap so as to protect the brush.

2. The cosmetic container according to claim 1, further including a brush cover that is put on the upper side of the brush and is coupled to the upper portion of the middle cap so as to put together the brush formed in the shaft tube of the middle cap.

3. The cosmetic container according to claim 1, wherein, on the lower surface of the middle cap, a stopper is formed, of which a portion is inserted into a concave section of the lower cap and is rotated so that the middle cap is rotated in the range of a predetermined angle with respect to the lower cap, and in the upper portion of the lower cap, two rotating limiting walls are formed to limit the rotation range of the stopper.

4. The cosmetic container according to claim 3, wherein the angle range defined by the rotation limiting walls formed in the upper portion of the lower cap is less than 180°.

5. The cosmetic container according to claim 1, wherein, in the hole formed in the center of the lower cap, a key groove is formed so that the packing body coupled to the lower cap is prevented from being rotated when the middle cap is rotated, and on the outer circumference of the packing body, a key is formed in the vertical direction.

6. The cosmetic container according to claim 1, wherein, on the lower portion of the outer circumference of the opening section of the container and the lower portion of the inner circumference of the lower cap, latch gears are respectively formed so that the fixing of the lower cap screw-coupled to the opening section of the container is not released.

7. A cosmetic container comprising:

a container having an opening section formed in one side thereof, through which cosmetic liquid is filled in a containing section;

a packing body having an open hole formed in a portion of an end portion thereof so as to provide a discharge path of cosmetic liquid, the packing body being inserted and coupled to the opening section of the container;

a middle cap that is rotatably coupled to an upper portion of the container and has a shaft tube formed in the center thereof, the shaft tube having a cutaway portion formed by cutting a portion of a lower end of the shaft tube along the circumference of the shaft tube in the position in order to be aligned to the open hole of the packing body or be closed with respect to the open hole of the packing body selectively by rotation of the middle cap and being inserted into a spatial section of the packing body so as to provide the discharge path of cosmetic liquid;

a brush that is formed on the upper portion of the shaft tube; and an external cap that is coupled to the upper portion of the middle cap so as to protect the brush;

wherein, on the lower surface of the middle cap, a stopper is formed, which is partially inserted into a concave section of the container and is rotated so that the middle cap is rotated in the range of a predetermined angle with respect to the container, and in the upper portion of the container, two rotation limiting walls are formed to limit the rotation range of the stopper.

* * * * *